United States Patent [19]

Silversberg

[11] 4,218,125

[45] Aug. 19, 1980

[54] PNEUMATIC SYSTEM FOR SUPPORTING A PHOTOCONDUCTIVE SURFACE

[75] Inventor: Morton Silversberg, Rochester, N.Y.

[73] Assignee: Xerox Corporation, Stamford, Conn.

[21] Appl. No.: 953,310

[22] Filed: Oct. 20, 1978

[51] Int. Cl.[2] ..... G03G 15/00

[52] U.S. Cl. ..... 355/3 BE; 198/811; 355/16

[58] Field of Search ..... 355/3 R, 3 BE, 16; 198/811, 841; 226/97; 271/195

[56] References Cited

U.S. PATENT DOCUMENTS

| | | | |
|---|---|---|---|
| 3,297,221 | 1/1967 | Licht et al. | 226/97 |
| 3,367,035 | 2/1968 | Tomlinson | 226/97 X |
| 3,694,068 | 9/1972 | Jordan | 355/3 BE |
| 3,941,238 | 3/1976 | Lapeyre | 198/811 |
| 4,062,321 | 12/1977 | Greenig | 226/97 X |

FOREIGN PATENT DOCUMENTS

| | | | |
|---|---|---|---|
| 30374 | 12/1968 | Japan | 226/97 |

*Primary Examiner*—Fred L. Braun

*Attorney, Agent, or Firm*—James J. Ralabate; Clarence A. Green; Henry Fleischer

[57] ABSTRACT

An apparatus in which a belt is supported to move in a pre-determined path. A pressurized fluid flows between the belt and at least one support with the side marginal regions being sealed to substantially reduce leakage thereat. This forms a fluid film which at least partially supports the belt and reduces friction between the belt and support.

12 Claims, 5 Drawing Figures

PNEUMATIC SYSTEM FOR SUPPORTING A PHOTOCONDUCTIVE SURFACE

BACKGROUND OF THE INVENTION

This invention relates to an electrophotographic printing machine, and more particularly concerns an improved apparatus for supporting a moving photoconductive belt.

In an electrophotographic printing machine, a photoconductive belt is charged to a substantially uniform potential so as to sensitize the surface thereof. The charged portion of the photoconductive belt is exposed to a light image of an original document being reproduced. Exposure of the charged photoconductive belt selectively discharges the charge thereon in the irradiated areas. This records an electrostatic latent image on the photoconductive belt corresponding to the informational areas contained within the original document being reproduced. After the electrostatic latent image is recorded on the photoconductive belt, the latent image is developed by brining a developer mix into contact therewith. Generally, the developer mix comprises toner particles adhering triboelectrically to carrier granules. The toner particles are attracted from the carrier granules to the latent image forming a toner powder image on the photoconductive belt. The toner powder image is then transferred from the photoconductive belt to a copy sheet. Finally, the copy sheet is heated to permanently affix the toner particles thereto in image configuration. This general approach was originally disclosed by Carlson in U.S. Pat. No. 2,297,691, and has been further amplified and described by many related patents in the art.

Existing photoconductive belt supports utilize two or more rolls for drive and support. Each roll may cause belt run-out, and lateral skew, as well as producing frictional resistance to belt steering. Furthermore, particles may be entrapped between the belt and rolls resulting in belt scoring. Herinbefore precise elastomerically coated rollers, sealed bearings, mounting the rollers in self-aligning assemblies and/or providing for accurate mounting of the rollers and relatively complex and/or low latitude tracking systems were required. Alternatively, it is desirable to employ a single drive roller and one or more air posts. Generally, an air post has an arcuate portion with a pressurized fluid, such as air, being supplied to the region between the arcuate portion and the photoconductive belt. The pressurized fluid is supplied through porous regions in the arcuate portion or via small apertures therein. These apertures are generally located just inside the tangent lines between the belt and the arcuate portion or directly under the pressurized load. This results in forming a gap between the photoconductive belt and the arcuate portion. The gap is a minimum at the tangent exit and entry regions. Most of the pressurized fluid tends to escape from the side marginal portions. Fluid consumption may be reduced by sealing the side marginal portions. This minimizes the required fluid flow and volume so as to reduce the cost associated with the system.

In addition to employing rows of holes or porous regions in the walls of the air post, it is frequently advantageous to form a pattern of grooves in the surface of the post. This latter structure requires relatively few large diameter apertures conduct the pressurized fluid to the grooves. A system of this type employs large diameter holes which are less likely to become clogged.

Holes of this type are easier to generate and the spacing between adjacent holes is not very critical. This system requires less power and is more economical to manufacture.

Accordingly, it is a primary object of the present invention to improve the pneumatic system furnishing pressurized fluid for supporting a belt moving in a predetermined path.

SUMMARY OF THE INVENTION

Briefly stated, and in accordance with the present invention, there is provided an apparatus for supporting a belt arranged to move in a pre-determined path.

Pursuant to the features of the invention, the apparatus includes at least one post arranged to provide support for the belt. Means supply a pressurized fluid between at least a portion of the post and the belt. This forms a fluid film which at least partially supports the belt with the friction between the belt and post being reduced. Means, associated with the post, seal the space between opposed side marginal regions of the belt and post so as to substantially reduce leakage thereat. Means are provided for moving the belt in the pre-determined path.

BRIEF DESCRIPTION OF THE DRAWINGS

Other objects and advantages of the present invention will become apparent upon reading the following detailed description and upon reference to the drawings, in which.

While the present invention will hereinafter be described in connection with preferred embodiments thereof, it will be understood that it is not intended to limit the invention to these embodiments. On the contrary it is intended to cover all alternatives, modifications and equivalents as may be included within the spirit and scope of the invention as defined by the appended claims.

DETAILED DESCRIPTION OF THE INVENTION

Figure 1:
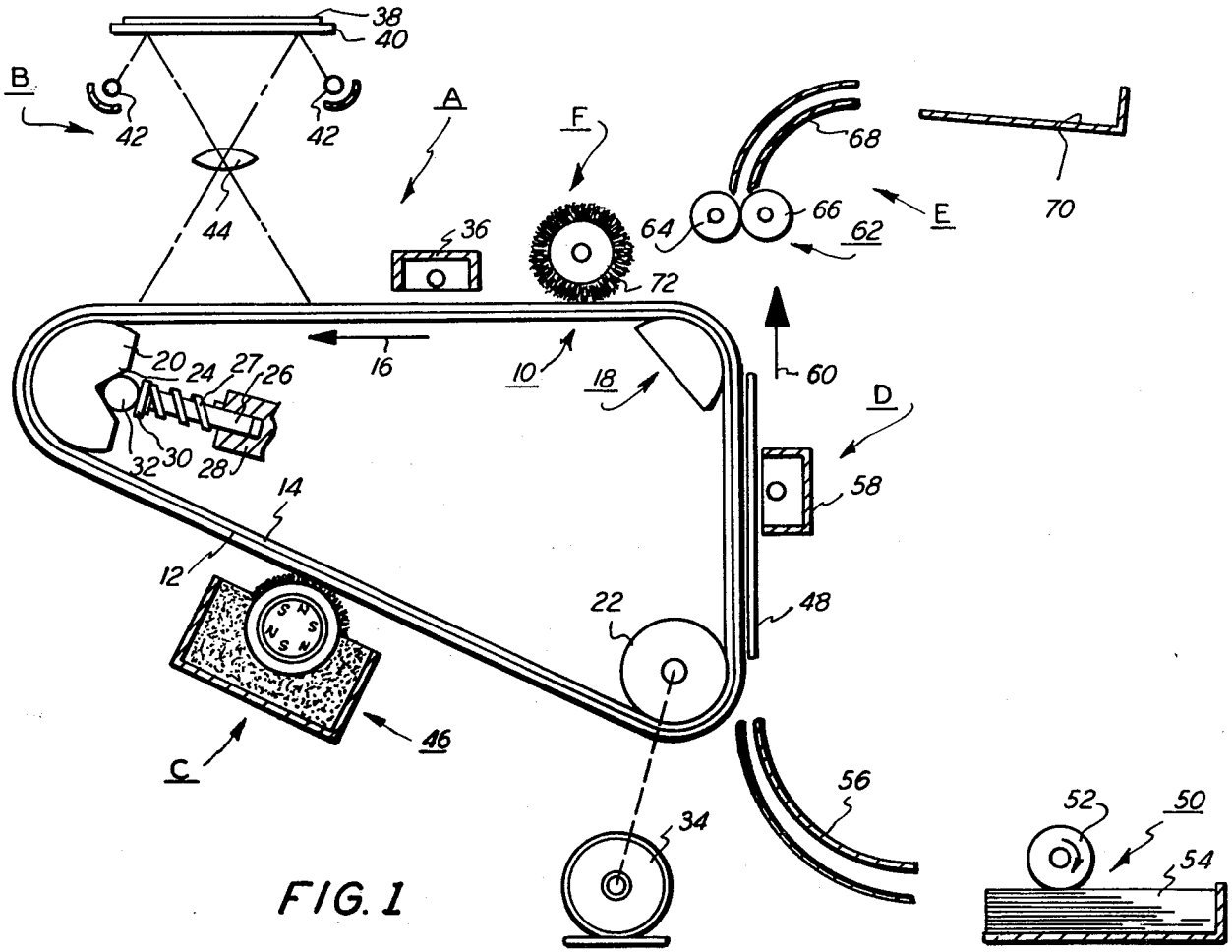
FIG. 1 is a schematic elevational view depicting an electrophotographic printing machine incorporating the features of the present invention therein.

For a general understanding of the illustrative electrophotographic printing machine incorporating the features of the present invention therein, reference is had to the drawings. In the drawings, like reference numerals have been used throughout to designate identical elements. FIG. 1 schematically depicts the various components of an electrophotographic printing machine employing a pneumatic system for forming a fluid film about the belt supports. Although the belt support pneumatic system is particularly well adapted for use in an electrophotographic printing machine, it will become evident from the following discussion that it is equally well suited for use in a wide variety of devices and is not necessarily limited in its application to the particular embodiment shown herein.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10 having a photoconductive surface 12 deposited on a conductive substrate 14. Preferably, photoconductive surface 12 is made from a selenium alloy with a conductive substrate 14 being made from an aluminum alloy. Belt 10 moves in the direction of arrow 16 to advance successive portions of photoconductive surface 12 sequentially through the various processing stations disposed about the path of movement thereof. Belt 10 is entrained about steering post 18, tension post 20, and drive roller 22. Tension post 20 is mounted resiliently on a spring and arranged to pivot about an axis substantially normal to the longitudinal axis thereof. The pivot axis is substantially normal to the plane defined by the approaching belt 10. More particularly, tension post 20 have a V-groove 24 therein. One end portion of bar 26 is mounted slidably in frame 28. The other end portion of bar 26 includes a flange 30 engaging a ball 32. A spring 27 is wound about bar 26 and interposed between flange 30 and frame 28. In this way, bar 26 is urged resiliently toward post 20 and presses flange 30 into engagement with ball 32. Ball 32, in turn, presses against post 20 so as to maintain the desired tension in belt 10.

Steering post 18 is mounted pivotably and tilts in a direction to reduce the approach angle of belt 10 to drive roller 22, i.e. the belt velocity vector relative to the normal to the drive roller axis of rotation. This restores belt 10 to the pre-determined path of movement minimizing lateral deflection. Post 18 is adapted to pivot about an axis substantially normal to the longitudinal axis thereof. The pivot axis is substantially perpendicular to the plane defined by the approaching belt 10. Drive roller 22 is in engagement with belt 10 and advances belt 10 in the direction of arrow 16. Roller 22 is rotated by motor 34 coupled thereto by suitable means, such as a belt. A common blower system is connected to steering post 18 and tension post 20. The blower system furnishes pressurized fluid, i.e. a compressible gas such as air, into the interior chamber of the respective posts. The fluid egresses from the interior chamber through apertures to form a fluid film between belt 10 and the respective post, i.e. steering post 18 and tension post 20. In this manner, the fluid film at least partially supports the belt as it passes over the respective post diminishing friction therebetween. The details of the pneumatic system, the belt seals, and the post structure are shown in FIGS. 2 through 5, inclusive.

With continued reference to FIG. 1, initially a portion of belt 10 passes through charging station A. At charging station A, a corona generating device, indicated generally by the reference numeral 36, charges photoconductive surface 12 of belt 10 to a relatively high, substantially uniform potential. A suitable corona generating device is described in U.S. Pat. No. 2,836,725 issued to Vyverberg in 1958.

Next, the charged portion of photoconductive surface 12 is advanced through exposure station B. At exposure station B, an original document 38 is positioned face-down upon transparent platen 40. Lamps 42 flash light rays onto the original document. The light rays reflected from the original document are transmitted through lens 44 forming a light image. This light image is projected onto the charged portion of photoconductive surface 12. The charged photoconductive surface is selectively discharged by the light image of the original document. This records an electrostatic latent image on photoconductive surface 12 which corresponds to the informational areas contained within original document 38.

Thereafter, belt 10 advances the electrostatic latent image recorded on photoconductive surface 12 to development station C. At development station C, a magnetic brush developer roller 46 advances the developer mix into contact with the electrostatic latent image recorded on photoconductive surface 12 of belt 10. The developer mix comprises carrier granules having toner particles adhering triboelectrically thereto. The magnetic brush developer roller forms a chain-like array of developer mix extending in an outwardly direction therefrom. The developer mix contacts the electrostatic latent image recorded on photoconductive surface 12. The latent image attracts the toner particles from the carrier granules forming a toner powder image on photoconductive surface 12 of belt 10.

The toner power image deposited on photoconductive surface 12 of belt 10 is then transported to transfer station D. At transfer station D, a sheet of support material 48 is positioned in contact with the toner powder image on photoconductive surface 12. The sheet of support material is advanced to the transfer station by sheet feeding apparatus 50. Preferably, sheet feeding apparatus 50 includes a feed roll 52 contacting the uppermost sheet of the stack 54 of sheets of support material. Feed roll 52 rotates so as to advance the uppermost sheet from stack 54 into chute 56. Chute 56 directs the advancing sheet of support material into contact with photoconductive surface 12 of belt 10 in a timed sequence so that the powder image developed thereon contacts the advancing sheet of support material at transfer station D. Transfer station D includes a corona generating device 58 which applies a spray of ions to the backside of sheet 48. This attracts the toner powder image from photoconductive surface 12 to sheet 48. After transfer, the sheet continues to move in the direction of arrow 60 and is separated from belt 10 by a detack corona generating device (not shown) which neutralizes the charge thereon causing sheet 48 to adhere to belt 10. A conveyor system (not shown) advances the sheet from belt 10 to fusing station E.

Fusing station E includes a fuser assembly, indicated generally by the reference numeral 62, which permanently affixes the transferred toner powder image to sheet 48. Preferably, fuser assembly 62 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, chute 68 guides the advancing sheet 48 to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a rotatably mounted fiberous brush 72 in contact with photoconductive surface 12 of belt 10. The particles are cleaned from photoconductive surface 12 by the rotation of brush 72 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine.

Figure 2:
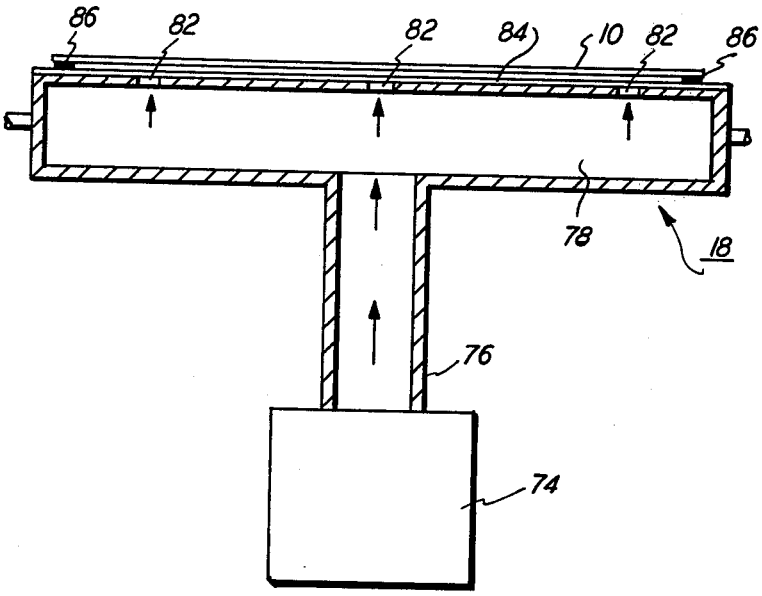
FIG. 2 is an elevational view, partially in section, showing the operation of the pneumatic system used in the FIG. 1 printing machine.

Referring now to the specific subject matter of the present invention, FIG. 2 depicts the pneumatic system associated with tension post 20 and steering post 18. For convenience, only steering post 18 will be discussed since the arrangement is substantially identical for tension post 20.

Figure 5:
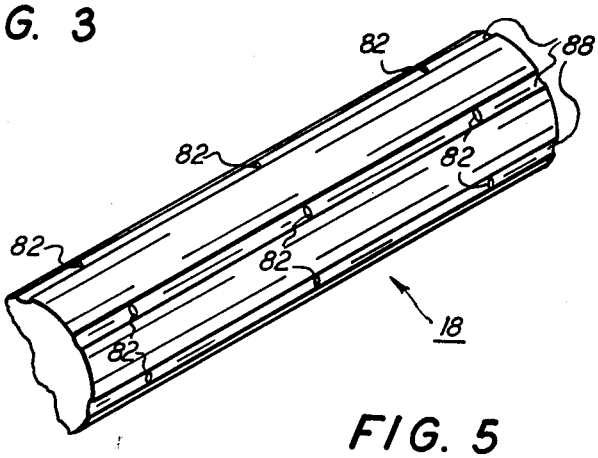
FIG. 5 is a fragmentary perspective view illustrating a support post employed in the FIG. 2 pneumatic system.

Turning now to FIG. 2, there is shown the detailed structure of the pneumatic system associated with steering post 18 for supporting belt 10 with a fluid film. As shown in FIG. 2, blower 74 is coupled via conduit 76 to interior chamber 78 of post 18. Compressed air, furnished from blower 74, moves in the direction of arrow into chamber 78 of post 18. Post 18 includes a plurality of apertures 82 spaced along the longitudinal axis of post 18 and positioned in the circumferential surface thereof substantially along the tangency line of belt 10 relative to post 18. Apertures 82 intersect grooves extending substantially parallel to the longitudinal axis of post 18. The grooves in the surface of post 18 are depicted in FIG. 5. Compressed air flows through apertures 82 into the grooves in post 18 and into gap 84 between belt 10 and the circumferential surface of post 18. The compressed air is under pressure and supplies the supporting force for belt 10 so at least to partially space belt 10 from the circumferential surface of post 18 minimizing friction therebetween as belt 10 moves in the direction of arrow 16 (FIG. 1).

Figure 3:
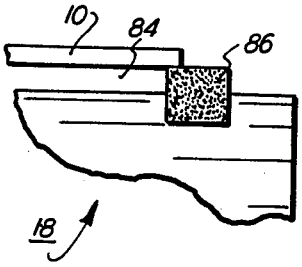
FIG. 3 is a fragmentary elevational view showing one embodiment of a seal employed in the FIG. 2 pneumatic system.
Figure 4:
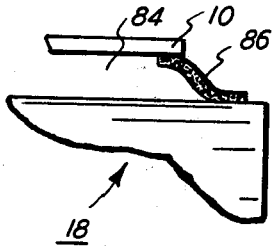
FIG. 4 is a fragmentary elevational view showing another embodiment of a seal used in the FIG. 2 pneumatic system.

Compressed air tends to escape from beneath the side marginal portions of belt 10. Air consumption can be reduced by sealing these regions. This may be accomplished with resilient end seals 86. The detailed structure of end seals 86 is shown in FIGS. 3 and 4. End seals 86 introduce a small amount of drag but most of the support for the photo-conductive belt is by the pressurized air film. The end seals minimize the required air flow for the respective tension or steering post and thus minimize the required air flow volume of the required air supply, i.e. blower 74. In this way, the system cost is significantly reduced.

The required air pressure is a function of the minimum radius of curvature of the post, web tension, range of width, and maximum pressures applied to belt 10 at development station C and cleaning station F. For example, if a post has a radius of ½ inch and 1 pound per inch of tension, the minimum required pressure is 2 psi. Posts with a larger radius of curvature (supplied from this same source) require means for limiting the air flow. This may be achieved by smaller holes or a constriction in the supply line.

Referring now to FIG. 3, there is shown one embodiment of end seal 86. As depicted thereat, end seal 86 extends about the circumferential surface of post 18 in a radial groove 88 therein. The uppermost surface of seal 86 is above the circumferential surface of post 18 and engages the side marginal end region of belt 10. Only one end seal is shown in FIG. 3 as the other end seal is substantially identical thereto. Preferably, end seal 86 is made from a soft closed cell urethane material.

An alternate embodiment of end seal 86 is depicted in FIG. 4. As shown thereat, a lip-type of seal 86 has one end portion thereof secured to the circumferential surface of post 18. The other end portion of seal 86 engages the side marginal region of belt 10. Once again, only one end seal is depicted inasmuch as the other end seal is substantially identical thereto. End seal 86 extends about the circumferential surface of post 10 so as to be in engagement with belt 10 preventing leakage in the side marginal portions thereof. Preferably, end seal 86 is made from a resilient elastomeric material, such as rubber. Both of the end seals depicted in FIGS. 3 and 4 must be substantially non-porous so as to prevent the flow of compressed air therethrough.

Turning now to FIG. 5, there is shown the arrangement of grooves 88 in post 18. Once again, the grooves in post 18 are substantially identical to those in post 20. As shown in FIG. 5, a plurality of equally spaced grooves 88 extend substantially parallel to the longitudinal axis of post 18. Grooves 88 are in the arcuate portion of post 18 and intersect apertures 82 so that the compressed air egresses from chamber 78 (FIG. 2) through aperture 82 into grooves 88 to form a fluid support film in gap 84 (FIG. 2). By way of example, three grooves 88 are shown disposed about circumferential surface of post 18. Grooves 88 are substantially equally spaced from one another. However, any number of equally or unequally spaced grooves may be employed to achieve the requisite pressure profile.

An air post system of this type can be fabricated by low cost molding or extrusion processes. The pneumatic support system for the belt eliminates the need for sealed bearings and their associate drag. In addition, photoconductive belt variations due to roller run-out are eliminated. Elimination of lateral friction permits the ready correction of tracking errors in the system through the use of a steering post. The system responds rapidly due to this low friction.

In recapitulation, it is evident that the pneumatic system of the present invention minimizes air flow requirements and provides a fluid support for a photoconductive belt. This significantly reduces friction between the respective supports and the belt simplifying tracking corrections. End seals reduce air consumption which, in turn, significantly reduces the air flow requirements and results in lower cost. Air post construction is simplified by employing a plurality of grooves in the circumferential surface thereof extending substantially parallel to the longitudinal axis of the respective posts. Grooves of this type intersect a few large holes to permit the air to form a fluid film in the gap between the belt and the post. Holes of this type are less expensive to form and reduce the required tolerances on the spacing of the holes. Hence, this pneumatic system is relatively inexpensive and simple to manufacture.

It is, therefore, evident that there has been provided in accordance with the present invention, a pneumatic system for supporting a photoconductive belt moving in a pre-determined path. This system fully satisfies the objects, aims, and advantages hereinbefore set forth. While this invention has been described in conjunction with specific embodiment thereof, it is evident that many alternatives, modifications and variations will be apparent to those skilled in the art. Accordingly, it is intended to embrace all such alternatives, modifications, and variations as fall within the spirit and broad scope of the appended claims.

What is claimed is:

1. An apparatus for supporting a belt arranged to move in a pre-determined path, including:

at least one post positioned to have the belt move thereover;

means for supplying pressurized fluid between at least a portion of said post and the belt to form a fluid film at least partially supporting the belt and reducing friction between the belt and said post;

a pair of opposed, spaced resilient members with each of said pair of members being secured to said post and in sliding contact with opposed side marginal regions of said belt for sealing the space between opposed side marginal portions of the belt and said post to substantially reduce fluid leakage thereat while maintaining sliding friction between said belt and said pair of resilient members at a minimum; and means for moving the belt in the pre-determined path.

2. An apparatus as recited in claim 1, wherein each of said pair of members are made from a urethane material.

3. An apparatus as recited in claim 1, wherein each of said pair of members are made from an elastomeric strip.

4. An apparatus as recited in claim 1, wherein said post includes an elongated arcuate portion having a plurality of grooves extending substantially parallel to the longitudinal axis thereof and a plurality of apertures therein to place an interior chamber of said post in communication with the grooves therein, said supplying means being in communication with the chamber in said post so that the pressurized fluid flows substantially in the grooves.

5. An apparatus as recited in claim 1, further including:

a tension post spaced from said first mentioned post; and at least one spring resiliently urging said tension post toward the belt to maintain the belt passing thereover under tension.

6. An apparatus as recited in claim 1, wherein said moving means includes:

a drive roller in engagement with the belt; and means for rotating said drive roller to move the belt in the pre-determined path.

7. An electrophotographic printing machine of the type having a photoconductive belt arranged to move in a pre-determined path through a plurality of processing stations disposed thereabout, wherein the improvement includes:

at least one post positioned to have the belt move thereover;

means for supplying a pressurized fluid between at least a portion of said post and the belt to form a fluid film at least partially supporting the belt and reducing friction between the belt and said post;

a pair of opposed, spaced resilient members with each of said pair of members being secured to said post and in sliding contact with opposed side marginal regions of said belt for sealing the space between opposed side marginal regions of the belt and said post to substantially reduce fluid leakage thereat while maintaining sliding friction between said belt and said pair of resilient members at a minimum; and means for moving the belt in the pre-determined path.

8. A printing machine as recited in claim 7, wherein each of said pair of members are made from a urethane material.

9. A printing machine as recited in claim 7, wherein each of said pair of members are made from an elastomeric strip.

10. A printing machine as recited in claim 7, wherein said post includes an elongated arcuate portion having a plurality of grooves extending substantially parallel to the longitudinal axis thereof and a plurality of apertures therein to place an interior chamber of said post in communication with the grooves therein, said supplying means being in communication with the chamber in said post so that the pressurized fluid flows substantially in the grooves.

11. A printing machine as recited in claim 7, further including:

a tension post spaced from said first mentioned post; and at least one spring resiliently urging said tension post toward the belt to maintain the belt passing thereover under tension.

12. A printing machine as recited in claim 7, wherein said moving means includes:

a drive roller in engagement with the belt; and means for rotating said drive roller to move the belt in the pre-determined path.

* * * * *